US005448829A

United States Patent [19]

Dillner et al.

[11] Patent Number: 5,448,829

[45] Date of Patent: Sep. 12, 1995

[54] HOLLOW TITANIUM BLADE MANUFACTURING

[75] Inventors: James R. Dillner, Amston; Peter E. Leibfried, Vernon, both of Conn.

[73] Assignee: United Technologies Corporation, Hartford, Conn.

[21] Appl. No.: 189,384

[22] Filed: Jan. 31, 1994

[51] Int. Cl.[6] ..... B23P 15/00

[52] U.S. Cl. ..... 29/889.722; 29/889.7; 29/463

[58] Field of Search ..... 29/889.72, 889.722, 29/889.7, 463, 428; 416/241 R

[56] References Cited

U.S. PATENT DOCUMENTS 5,063,662 11/1991 Porter et al. ..... 29/889.72
5,083,371 1/1992 Leibfried et al. ..... 29/889.7
5,139,887 8/1992 Sutton ..... 428/586

FOREIGN PATENT DOCUMENTS 0437692 11/1935 United Kingdom ..... 29/889.72
786940 11/1957 United Kingdom ..... 29/889.72

*Primary Examiner*—Irene Cuda
*Attorney, Agent, or Firm*—Edward L. Kochey, Jr.

[57] ABSTRACT

A titanium gas injection tube 18 is located within a counterbore (16) in the blade (10) halves which are to be bonded and formed. An internal stainless steel sleeve (24) is placed in the counterbore inside the titanium tube to resist bonding forces. An external stainless steel sleeve (28) is placed around the tube to resist gas pressure forces.

3 Claims, 1 Drawing Sheet

HOLLOW TITANIUM BLADE MANUFACTURING

TECHNICAL FIELD

The invention relates to a method of forming hollow titanium fan blades and in particular to the use of a gas tube for gas pressure introduction.

BACKGROUND OF THE INVENTION

Hollow fan or compressor blades are used to provide stiff lightweight blades. Titanium is used for these blades because of the high strength provided with low weight. This material selection is made despite the many problems in the forming of titanium structures.

One method of forming such a titanium blade is shown in U.S. Pat. No. 5,063,662 issued Nov. 12, 1991 to Porter et al. There, two blade halves are machined and diffusion bonded together. A gas injection tube is simultaneously bonded between the two halves. The blade is later twisted and formed at high temperature, with gas pressure introduced inside the blade.

These gas tubes used in the manufacturing of hollow blades introduce gas pressure inside the part to remove any skin buckles or irregularities during processing, particularly final forming. The tubes are placed in slots machined into detail halves and bonded to the part as part of the bond cycle. It is important that a good seal exist at the interface between the gas tube and the bonded blade because a leak will cause internal-contamination of the part during subsequent operations.

During the forming operation the material is at a temperature such that the internal gas pressure will cause the material to deform. With the gas tube of the same material as the blade, the tube will deform and therefore be unable to contain the pressure. Accordingly early parts used a tube made of stainless steel for the portion outside the blade with titanium forming the portion inside the blade. Since these materials cannot easily be joined, a tantalum interface was located between the two materials.

The titanium end was placed in the slot for bonding, with the stainless steel end attached to the gas supply line and exposed to the environment. The stainless steel would withstand the applied gas pressure without deformation in the final formation. However the titanium interface would oxidize and become brittle causing failure. Furthermore the titanium tube within the blade detail would sometimes either be crushed closed during the diffusion bonding portion, or insufficiently resist the pressure of the two halves resulting in a poor bond.

Stainless steel tubes plated with copper nickel were then used. The copper nickel plating would act as a braze material at bond temperatures allowing the tubes to be brazed in position and provide a good seal. The problem with this braze is that the plating material, copper, would migrate into the bond plane of the part, creating an unacceptable bond in that local area.

The need still exists for a gas tube which will form a good bond within the titanium blade without contaminating the interface, and which will withstand the applied gas pressure for formation of the final blade at temperature.

SUMMARY OF THE INVENTION

The method of installing the gas injection tube applies to a method of forming a titanium blade in two halves which are then diffusion bonded together. An opening to receive the gas injection flow is formed in at least one of the two halves of the blade. A counterbore is formed aligned with the opening for receiving the gas injection tube. A titanium gas tube is formed with this tube having a bonding end and an external connection end.

Within the counterbore there is placed an internal sleeve of a first material having high strength at the titanium diffusion bonding temperature, austenitic stainless steel being a preferred material. The bonding end of the titanium gas tube is placed within the counterbore in a position surrounding the internal sleeve, whereby the internal sleeve will resist the diffusion bonding pressure while the titanium tube will be in intimate contact with the two blade halves.

An external sleeve of a material having high strength at the blade forming temperature is formed. Austenitic stainless steel is also a preferred material here. The external sleeve is placed around the external connection end of the gas tube immediately adjacent the fan blade before or after the diffusion bonding. A gas supply connection, preferably of the compression fitting type, is connected to the gas tube immediately adjacent the other end of the external sleeve. This external sleeve supplies the resistance to internal pressure at the blade forming temperature.

DESCRIPTION OF THE PREFERRED EMBODIMENT

Figure 1:
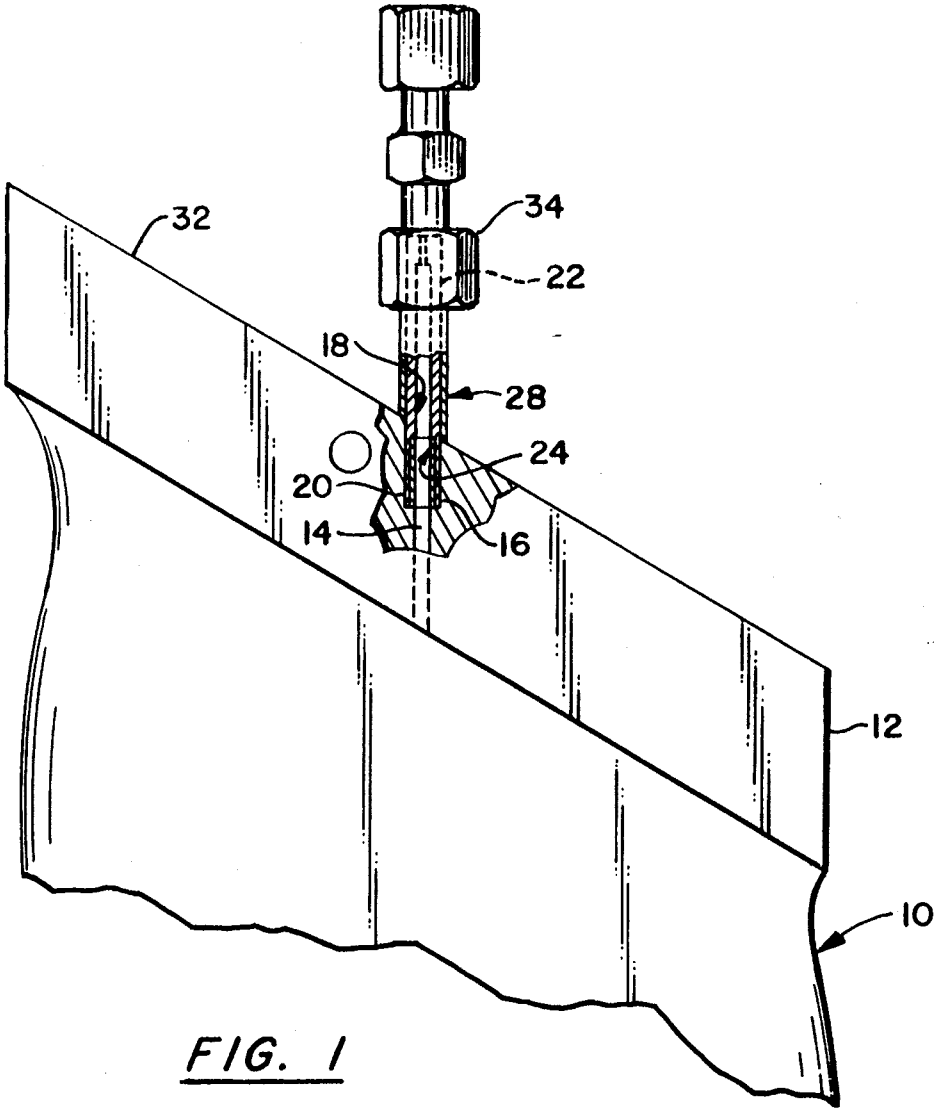
FIG. 1 is a view of a blade being formed with a gas tube in place.

Referring to FIG. 1 there is shown a titanium compressor blade 10 which is actually in two halves with a root portion 12. Contiguous openings 14 are formed in each blade portion with these openings being of such a depth and shape that the opening will not be closed during later diffusion bonding of the two blade portions. A counterbore 16 is formed from the outside of the blade end and aligned with opening 14. This is a circular opening for the receipt of the gas injection tube.

Figure 2:
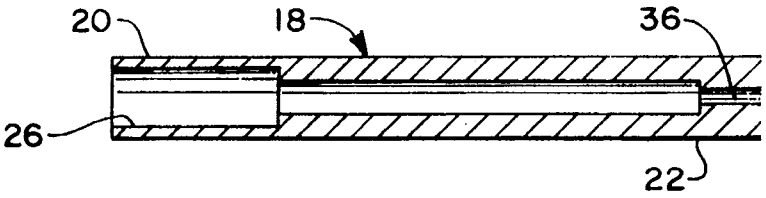
FIG. 2 is a detail of the titanium gas tube.

A titanium gas injection tube 18 is located within the counterbore with the details of this tube being shown in FIG. 2. The tube has a bonding end 20 and an external connection end 22.

Figure 3:
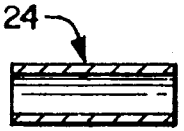
FIG. 3 is a detail of the internal sleeve.
Figure 4:
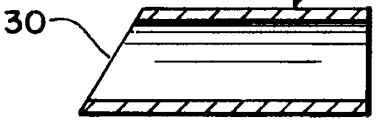
FIG. 4 is a detail of the external sleeve.

FIG. 3 shows a detail of an internal sleeve 24 which is made of a first material having high strength at the titanium diffusion bonding temperature, this temperature being about 1700° F. (871° C.). An austenitic stainless steel such as type 310 has been successfully used and therefore is preferred for this application. The sleeve 24 is located within the gas tube counterbore 26 of the bonding end 22 of the gas tube, and placed within the counterbore 16 of the blades. This arrangement is shown in FIG. 1, and of course the order of installation of these two components is a matter of choice.

At this point the blade portions may be diffusion bonded together. The opening 14 is sized so that it will not crush closed during the bonding. Sleeve 24 bucks up the bonding end 20 of the gas diffusion tube which not only prevents it from buckling closed, but also permits it to resist with sufficient force to achieve a good bond between the tube and the blade portions.

An external sleeve 28 is formed of a second material having high strength at the titanium blade forming temperature. Austenitic stainless steel of type 310 is also satisfactory here. The end 30 of the sleeve is formed so that it may be located immediately adjacent the end 32 of the blade details.

This sleeve is placed over the external connection end 22 of the now bonded gas tube 18 with the sleeve immediately adjacent the surface 32. Gas supply connection 34 is located immediately adjacent the other end of the gas tube for connecting the gas supply to the gas injection tube 18. The sleeve 28 externally bucks the tube 18 resisting internal pressure during the application of internal gas pressure to the bonded blade 10. This occurs at a forming temperature of approximately 1550° F. (843° C.).

It is also preferable that the gas supply connection end of the gas tube have a particularly small opening 36. This permits the end of the tube to be electron beam welded closed for the diffusion bonding portion of the operation. The end may be cut or drilled for the later forming operation.

Thus a gas injection tube is intimately bonded to the titanium blade in the blades initial diffusion bonded state, without the opening for later gas supply being crushed closed. Furthermore, the titanium tube is buttressed for internal pressure during a later high temperature forming operation.

We claim:

1. A method of installing a gas injection tube between two portions of a diffusion bonded hollow titanium fan blade comprising:

forming an opening through at least one of said portions;

forming a counterbore from the outside of said blade and aligned with said opening;

forming a titanium gas tube having a bonding end and an external connection end;

placing within said counterbore an internal sleeve of a first material having high strength at the titanium diffusion bonding temperature;

placing within said counterbore the bonding end of said gas tube in a position surrounding said internal sleeve;

diffusion bonding said at least one portion of said hollow fan blade and said gas tube;

forming an external sleeve of a second material having high strength at the titanium blade forming temperature;

and placing said external sleeve around said connection end of said gas tube with one end adjacent said fan blade and securing a gas supply connection to said gas tube immediately adjacent the other end of gas tube.

2. The method of claim 1 wherein:

said step of forming an opening comprises forming a contiguous section of said opening in each of said portions.

3. The method of claim 1 wherein said first and second materials are austenitic stainless steel.

* * * * *